US012342933B1

(12) United States Patent
Ondrasik, Jr.

(10) Patent No.: US 12,342,933 B1
(45) Date of Patent: Jul. 1, 2025

(54) TILTING AND SLIDING SYSTEM FOR A SHELF HAVING SIDE SUPPORT RAILS RECEIVABLE BETWEEN SHELF SUPPORTS IN VERTICAL POSTS

(71) Applicant: THE ONDRASIK FAMILY TRUST DATED Nov. 3, 1999, Commerce, CA (US)

(72) Inventor: V. John Ondrasik, Jr., Granada Hills, CA (US)

(73) Assignee: THE ONDRASIK FAMILY, Commerce, CA (US), trust dated 11/3/1999

( * ) Notice: Subject to any disclaimer, the term of this patent is extended or adjusted under 35 U.S.C. 154(b) by 0 days.

(21) Appl. No.: 19/046,793

(22) Filed: Feb. 6, 2025

Related U.S. Application Data

(60) Provisional application No. 63/674,719, filed on Jul. 23, 2024, provisional application No. 63/574,655,
(Continued)

(51) Int. Cl.
*A47B 57/38* (2006.01)
*A47B 57/04* (2006.01)
(Continued)

(52) U.S. Cl.
CPC ..... *A47B 57/38* (2013.01); *A47B 57/04* (2013.01); *A47B 96/021* (2013.01);
(Continued)

(58) Field of Classification Search
CPC ..... A47B 57/38; A47B 57/04; A47B 96/021; A47B 96/1408; A47B 57/406; A47B 57/30; A47B 57/06; A47B 57/00; A47B 57/08; A47B 57/10; A47B 57/123; A47B 57/14; A47B 57/20; A47B 57/22; A47B 57/36;
(Continued)

(56) References Cited

U.S. PATENT DOCUMENTS 395,328 A * 1/1889 Jewell ..... A47B 57/16 108/110
506,829 A * 10/1893 Ohmer ..... A47B 57/16 108/110
(Continued)

OTHER PUBLICATIONS

Drawings, Shelf, Rear Entry, Anthony, Inc., Aug. 4, 2018, 1 page.

*Primary Examiner* — Devin K Barnett
(74) *Attorney, Agent, or Firm* — David R. Heckadon; Gordon Rees Scully Mansukhani LLP

(57) ABSTRACT

A shelving system with a shelf, two rear vertical posts and two front vertical posts. The posts all have vertically spaced apart shelf supports thereon and the shelf has side support rails that are received between two of the vertically spaced apart shelf supports on the front vertical posts and two of the vertically spaced apart shelf supports on the rear vertical posts. The rear of the shelf can be raised or lowered and re-attached in a new position while the side support rails remain positioned between the shelf supports in the front vertical posts. If the rear or front of the shelf is accidentally dropped, the shelf rotates such that the side rails lock against the top and bottom of the vertically spaced apart shelf supports, thereby preventing the shelf from falling.

13 Claims, 8 Drawing Sheets

Related U.S. Application Data filed on Apr. 4, 2024, provisional application No. 63/551,374, filed on Feb. 8, 2024.

(51) Int. Cl.

| | |
|---|---|
| ***A47B 96/02*** | (2006.01) |
| ***A47B 96/14*** | (2006.01) |
| *A47B 57/06* | (2006.01) |
| *A47B 57/26* | (2006.01) |
| *A47B 57/30* | (2006.01) |

(52) U.S. Cl.

CPC ..... *A47B 96/1408* (2013.01); *A47B 57/06* (2013.01); *A47B 57/26* (2013.01); *A47B 57/30* (2013.01)

(58) Field of Classification Search

CPC ..... A47B 57/265; A47B 57/32; A47B 57/34; A47B 57/48; A47B 57/482; A47B 57/50; A47B 57/545

See application file for complete search history.

(56) References Cited

U.S. PATENT DOCUMENTS 1,876,172 A * 9/1932 Ruddy ..... A47B 57/04 108/1
1,983,858 A * 12/1934 Karnes ..... A47B 57/30 414/785
2,729,342 A * 1/1956 Saul, Jr. ..... A47B 57/08 211/187
2,788,949 A * 4/1957 Gurries ..... A47B 57/425 248/242
2,891,677 A * 6/1959 Ritchie ..... A47F 1/12 211/151
3,115,254 A * 12/1963 Ritchie ..... A47B 57/04 108/108
3,265,018 A * 8/1966 Joyce ..... A47B 57/08 108/109
3,279,618 A * 10/1966 Bergstedt ..... A47F 1/12 312/45
3,330,419 A * 7/1967 Henry ..... A47B 51/00 211/208
3,844,416 A * 10/1974 Potter ..... A47B 47/02 312/351
3,900,112 A * 8/1975 Azzi ..... B65G 1/023 211/151
4,142,638 A * 3/1979 Vargo ..... A47B 57/34 211/187
4,397,432 A * 8/1983 Resetar ..... B64D 11/00 5/8
4,457,239 A * 7/1984 Heinze ..... A47B 57/10 108/189
4,519,508 A * 5/1985 Gullett ..... A47F 1/12 211/175
5,048,699 A * 9/1991 Trevaskis ..... A47F 5/0087 211/128.1
5,152,491 A * 10/1992 Forster ..... A47B 19/08 248/460
5,333,746 A * 8/1994 Bustos ..... A47B 57/00 248/242
5,577,623 A * 11/1996 Bustos ..... A47B 96/02 211/187
5,607,068 A * 3/1997 Coretti, Jr. ..... A47F 5/135 211/59.2
5,797,502 A * 8/1998 Brady ..... A47B 57/40 211/183
5,845,794 A * 12/1998 Highsmith ..... A47F 5/13 211/151
5,884,567 A * 3/1999 Bartz, Jr. ..... A47B 57/265 108/106
5,992,651 A * 11/1999 Shaw ..... A47F 5/13 211/59.2
6,062,401 A * 5/2000 Hall ..... A47B 87/0246 211/186
6,132,158 A * 10/2000 Pfeiffer ..... B65G 13/12 211/151
6,158,600 A * 12/2000 Ferrucci ..... A47F 5/13 211/90.03
6,302,036 B1 * 10/2001 Carson ..... A47F 5/0031 211/175
6,332,547 B1 * 12/2001 Shaw ..... A47F 1/12 211/59.2
6,389,993 B1 5/2002 Ondrasik
6,490,983 B1 * 12/2002 Nicholson ..... A47F 1/12 108/106
6,526,897 B1 * 3/2003 Ondrasik ..... A47B 57/20 108/107
6,820,754 B2 11/2004 Ondrasik
6,871,747 B2 * 3/2005 Bustos ..... A47F 5/0056 211/187
6,948,900 B1 * 9/2005 Neuman ..... B65G 1/023 211/126.9
7,533,948 B2 * 5/2009 Smith ..... F25D 25/02 211/187
8,020,714 B2 * 9/2011 Miller, Jr. ..... A47F 3/0404 108/107
8,499,942 B1 * 8/2013 Coretti, Jr. ..... A47B 96/021 211/181.1
9,004,300 B1 * 4/2015 Morrell ..... A47B 96/024 248/242
9,357,840 B2 * 6/2016 Davis ..... A47B 91/00
9,770,122 B2 * 9/2017 Gonzalez ..... A47B 95/008
9,781,998 B2 * 10/2017 Mogensen ..... A47B 96/14
9,936,825 B1 * 4/2018 Lindblom ..... A47F 5/0087
10,021,972 B1 * 7/2018 Robinson ..... A47B 57/30
10,159,339 B1 * 12/2018 Powell ..... A47B 57/485
10,660,435 B2 * 5/2020 Miller, Jr. ..... F25D 25/02
10,709,237 B2 * 7/2020 Robinson ..... A47B 96/028
10,817,849 B1 * 10/2020 Nicoll ..... A47F 1/04
D905,482 S * 12/2020 Coretti, Jr. ..... D6/675.2
11,160,374 B1 * 11/2021 Davis ..... A47F 1/12
11,409,491 B2 8/2022 Nel
11,627,803 B1 * 4/2023 Chang ..... A47B 57/04 211/34
D996,096 S * 8/2023 McTavish ..... D6/675.4
11,771,015 B1 * 10/2023 Sale ..... B65D 19/385 211/85.8
11,944,213 B1 * 4/2024 Ondrasik, Jr. ..... E05B 73/0023
12,203,694 B2 1/2025 Ramirez et al.
2003/0029362 A1 2/2003 Ondrasik
2003/0084827 A1 5/2003 Nicholson et al.
2004/0065630 A1 4/2004 Ondrasik
2005/0127017 A1 * 6/2005 Kessel ..... A47B 57/06 211/187
2006/0076304 A1 * 4/2006 Kainuma ..... A47F 3/00 211/187
2006/0113262 A1 * 6/2006 Knorring, Jr. ..... A47F 5/0056 211/181.1
2007/0295681 A1 * 12/2007 Colin ..... A47F 5/12 211/90.03
2012/0298601 A1 * 11/2012 Biglow ..... A47F 5/101 211/59.2
2014/0263125 A1 * 9/2014 Gonzalez ..... A47B 96/06 248/250
2017/0055709 A1 * 3/2017 Nowe ..... A47B 57/16
2019/0357699 A1 * 11/2019 Sudds ..... A47B 47/0066
2021/0059385 A1 * 3/2021 Boos ..... A47F 5/12
2022/0185352 A1 * 6/2022 Ondrasik, Jr. ..... B62B 3/1476
2024/0341467 A1 * 10/2024 Chandrashekaraiah ..... A47B 57/42

* cited by examiner

TILTING AND SLIDING SYSTEM FOR A SHELF HAVING SIDE SUPPORT RAILS RECEIVABLE BETWEEN SHELF SUPPORTS IN VERTICAL POSTS

RELATED APPLICATIONS

The present application is related to Provisional Patent Application Ser. No. 63/551,374, of same title, filed Feb. 8, 2024, and to Provisional Patent Application Ser. No. 63/574,655, also of same title, filed Apr. 4, 2024, and to Provisional Patent Application Ser. No. 63/674,719, also of same title, filed Jul. 23, 2024; the entire disclosures of which are incorporated herein by reference in their entireties.

TECHNICAL FIELD

The present invention relates to shelving systems such as shelves used in product display cabinets, behind glass refrigerator doors or any other system where products are placed on shelves in supermarkets, convenience stores or other locations.

BACKGROUND OF THE INVENTION

Many different systems currently exist for positioning shelves. Unfortunately, to change the position of any of these shelves requires relocating brackets, attachments or other system components.

It would instead be desirable to provide a system that allows the shelf to be quickly and easily moved both back and forth (i.e.: in a horizontal direction), up and down and tilted to various non-horizontal angles. Moving the shelf back and forth in a horizontal direction would provide better visibility and would make it easier to remove the product from the shelf. Tilting the shelf forwards would be especially useful to ensure that the products loaded onto the shelf slide towards the front of the shelf for easy customer access. In addition, a shelf that can be tilted (i.e.: with its rear end lifted) and then quickly put back into a horizontal position can be loaded faster than a shelf that remains horizontal at all times. This is because as products are loaded onto the shelf (for example, milk cartons) they will easily slide towards the front of the shelf. Tilting the products forwards against another product will also prevent them from toppling over. Instead, the products will tend to slide towards one another, thereby filling the shelf as it is being loaded. Once the shelf has been fully loaded, it can be pushed back into the frame supporting it and put in a horizontal position again (if so desired). As will be shown, the Applicant's system permits quick, easy and safe movement of the shelf in a horizontal direction. It also permits quick, easy and safe rotation of the angle of the shelf.

In addition, it would also be desirable to provide a shelving system in which the shelf will bind (rather than simply fall) if the rear end (or front end) of the shelf is accidently dropped when it is being moved. This is especially problematic if there are products or goods sitting on the shelf making it heavier when an operator releases the rear end of the shelf to move the rear end of the shelf upwards or downwards to adjust the angle of the shelf. It would also be desirable for this safety system to operate if the front end of the shelf is accidently disconnected from the front vertical posts and is dropped (for example if the shelf is pulled to far back to adjust the height of the back of the shelf). As will be shown, the Applicant's system solves this problem without requiring springs, brackets or other attachment mechanisms.

SUMMARY OF THE INVENTION

In preferred aspects, the present system provides a shelving system, comprising:

(a) an assembly comprising:
- two front vertical posts having a series of vertically spaced apart shelf supports thereon, and
- two rear vertical posts having a series of vertically spaced apart shelf supports thereon; and (b) a shelf comprising:
- a main body,
- a pair of side support rails on the main body, wherein each of the side support rails are dimensioned to be received between two of the vertically spaced apart shelf supports on the front vertical posts and two of the vertically spaced apart shelf supports on the rear vertical posts.

In preferred embodiments, the side support rails have a series of bottom notches thereon. Preferably these bottom notches are on the rear ends of the side support rails and they lock onto the vertically spaced apart shelf supports on the vertical rear posts. These notches may be made in many shapes, including but not limited to saw-tooth shaped and may be positioned at many positions with respect to one another. If saw-tooth shaped, the notch may optionally be have a portion that locks against the vertically spaced apart shelf supports on the vertical rear posts. In optional embodiments, protrusions on the side support rails can be used instead of notches. The present system encompasses both embodiments (i.e.: notches where material is removed from the side rails, and protrusion where material is instead added or attached to the side rails).

In preferred embodiments, the rear of the shelf can be lifted to tilt the shelf forwardly while the side support rails remain positioned between two of the vertically spaced apart shelf supports on the front vertical posts. Alternatively, the rear of the shelf can be lowered to tilt the shelf backwardly while the side support rails again remain positioned between two of the vertically spaced apart shelf supports on the front vertical posts.

An added safety feature of the present system is that if the rear of the shelf is released and accidentally dropped, the side support rails will remain positioned between two of the vertically spaced apart shelf supports on the front vertical posts. In this case, the side support rails will simply rotate to lock against the vertically spaced apart shelf supports above and below the side support rails. As such, the shelf is prevented from falling. In addition, the present safety system will operate if the shelf is pulled too far backwards and becomes disconnected from the front vertical support posts. In this case, the side support rails will rotate and lock into the rear vertical post between its vertically spaced apart shelf supports.

In preferred embodiments, the front and rear vertical posts are at least partially tubular in cross section and may optionally be rectangular, circular, etc. In short, they may also optionally be made in many different shapes and constructions, including but not limited to T-shaped, U-shaped, I-shaped or C-shaped in cross section provided that shelf supports may be mounted thereon. Optionally, a plurality of shelves may be supported on the left and right sides of the vertical posts as well (for example in a long horizontal display cabinet). In preferred aspects, they may be made from a flat piece of metal, and then have apertures cut therethough or holes punched therein. Next, the planar piece of metal may be folded over and welded to form a tubular cross section which may be rectangular, circular, etc.

As such, the present system provides a novel mechanism for positioning the shelf such that the angle of the shelf and the vertical and horizontal position of the shelf with respect to the vertical posts can both be easily adjusted by easily moving the shelf to various positions.

DETAILED DESCRIPTION OF THE DRAWINGS

The present invention provides various systems for positioning a shelf (which may optionally be a wireframe shelf, but is not limited to wireframe shelves) such that both the angle of the shelf and the vertical and horizontal position of the shelf can both be adjusted quickly and easily.

Figure 1:
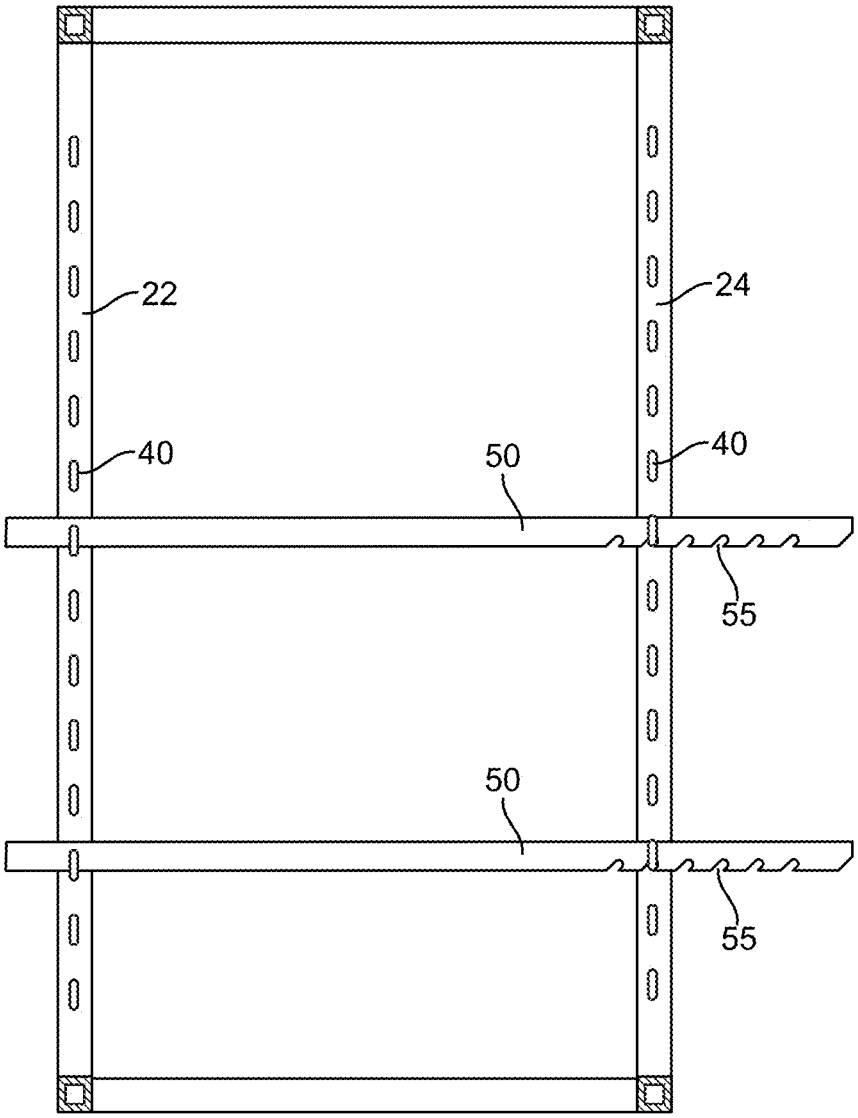
FIG. 1 is an interior elevation view of the present system with the side support rails of two shelves positioned horizontally.

FIG. 1 is an interior elevation view of the present system with the side support rails 50 of two shelves (10 in FIGS. 4, 6 and 7) positioned horizontally. The shelf 10 in this Figure, and in FIGS. 2A and 2B has been simplified for clarity of illustration. (For example the side stops which keep products from falling off of the shelves that are on the ends of the shelf have been removed). Shelf 10 has side rails 50 on either side. As such, for ease of illustration, shelf 10 is hidden from view in FIGS. 1 to 2B. Side rails 50 are supported by shelf supports 40 on each of front vertical post 22 and rear vertical post 24. Shelf supports 40 are vertically spaced apart on both front vertical post 22 and rear vertical post 24. Vertical posts 22 and 24 may be made with the same geometries or with different geometries. In addition, the shape of apertures 60 in these posts may be the same or different. Preferably, the shape of aperture 60 in each of vertical posts 22 and 24 will correspond to the shape of the side rail 50 passing therethrough.

Figure 2A:
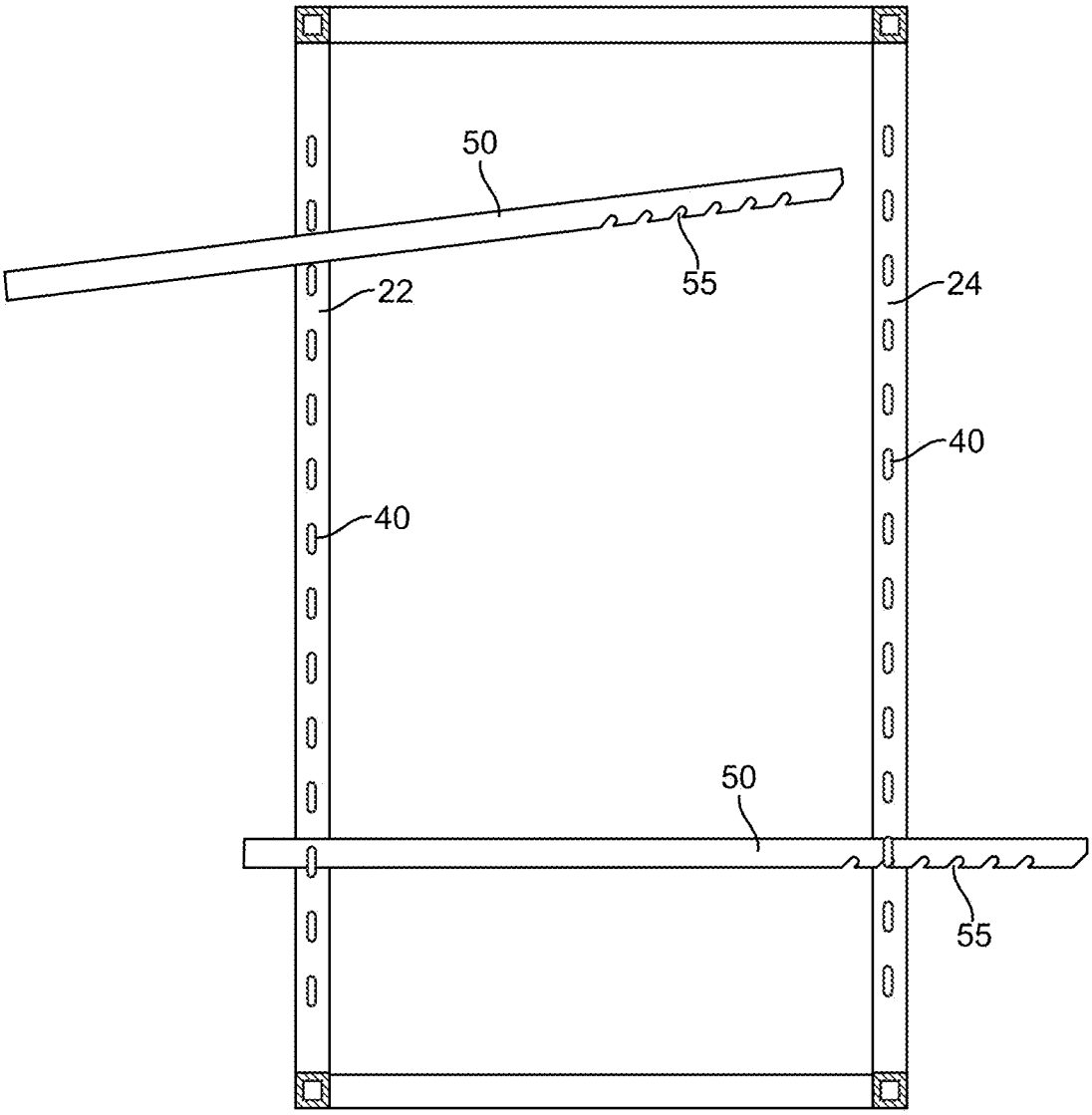
FIG. 2A is a view similar to FIG. 1, but with the top shelf being unlocked and moved to a different position.

FIG. 2A is a view similar to FIG. 1, but after the top shelf has been unlocked from the shelf supports 40 on rear vertical post 24 and moved to a different position (by first sliding the front end of rail 50 between two higher shelf supports.

Figure 2B:
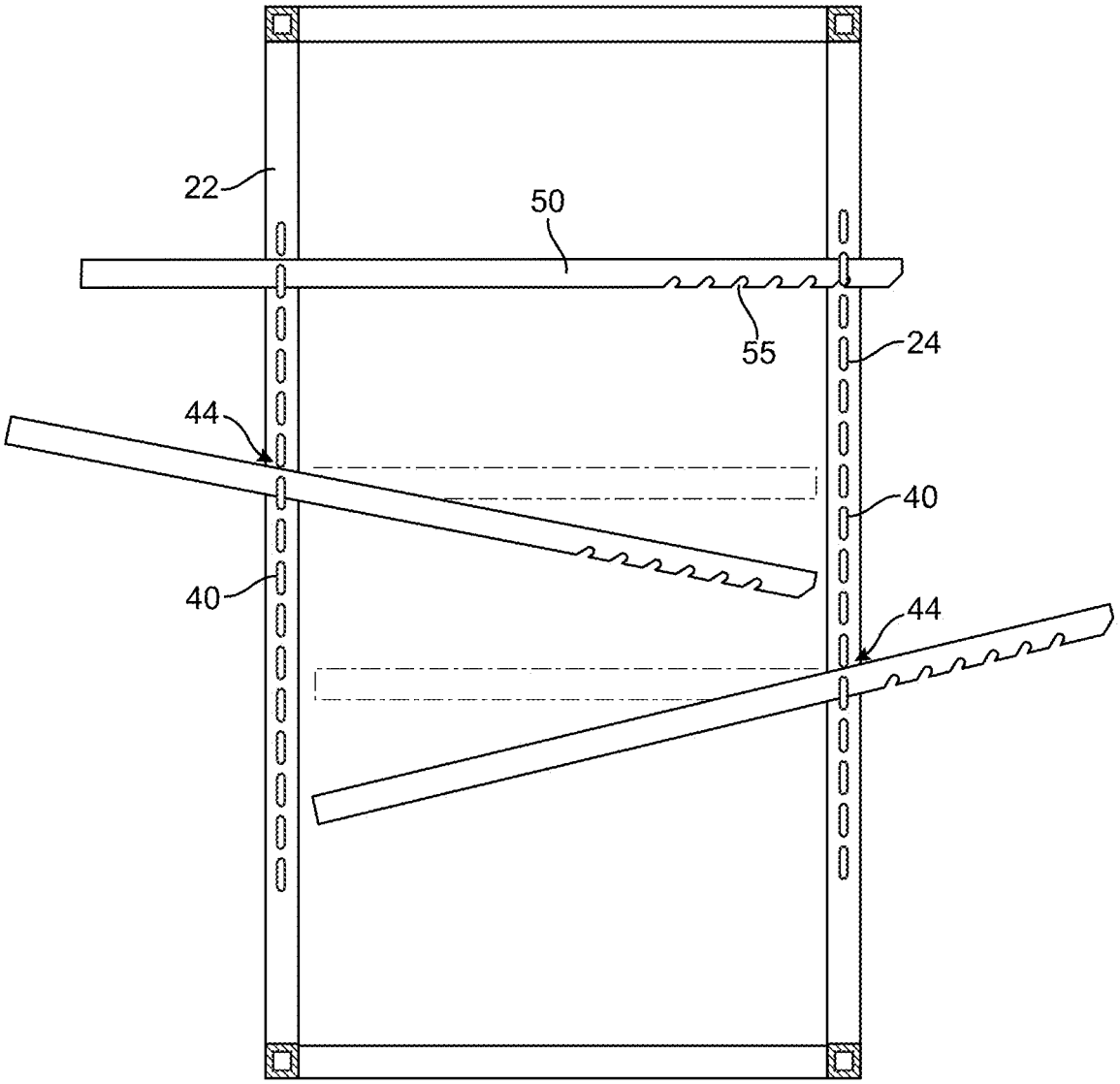
FIG. 2B is a view similar to FIG. 1, showing the side support rails of three shelves, with the middle and lower shelves unlocked at one end and accidently dropped, but with the shelves not falling. The initial horizontal position of these two unlocked shelves are shown in dotted lines.

FIG. 2B is a view similar to FIGS. 1 and 2A, instead showing the side support rails 50 of three different shelves. The top shelf side rail 50 is locked between shelf supports 40 on each of front vertical post 22 and rear vertical post 24. The middle and lower shelves (which were initially in the horizontal positions shown in dotted lines) have been unlocked at one end or the other and accidently dropped. As can be seen, neither of these shelves will fall to the ground, as they will instead rotate slightly, but bind against the shelf support 40 that is right above rail 50 at points 44.

As can be seen in the various Figures, the present shelving system includes a shelf 10 having a front end that is supported by front vertical posts 22 and a rear end that is supported by rear vertical posts 24. Shelf 10 may be a wireframe shelf or other form of shelf including shelves with continuous solid bottoms, etc. As seen in FIGS. 1 through 2A, shelf 10 may be positioned horizontally. The rear end of shelf 10 may be lowered and have its sliding rails 50 hooked into a lower position on rear vertical support 24. This tilts the shelf backwards. Alternatively, the rear end of shelf 10 may be raised and have its sliding rails 50 hooked into a higher position on rear vertical support 24. This tilts the shelf forwards.

In preferred embodiments, the present system provides a shelving system, comprising:

(a) an assembly comprising:
  two front vertical posts 22 having a series of vertically spaced apart shelf supports 40 thereon, and
  two rear vertical posts 24 having a series of vertically spaced apart shelf supports 40 thereon; and
(b) a shelf comprising:
  a main body 11,
  a pair of side support rails 50 on the main body, wherein each of the side support rails 50 are dimensioned to be received between two of the vertically spaced apart shelf supports 40 on the front vertical posts 22 and two of the vertically spaced apart shelf supports on the rear vertical posts 24.

As understood herein, reference to "shelf supports" 40 includes any form of connector, hook, tab, latch, etc. without limitation.

The unique advantages of the present system are achieved by, among other things, having side support rails 50 pass between shelf supports 40 in front and rear vertical posts 22 and 24. As will be shown, this provides a system where both the horizontal position of shelf 10 and the angle of shelf 10 can be adjusted and changed quickly and easily.

Figure 6:
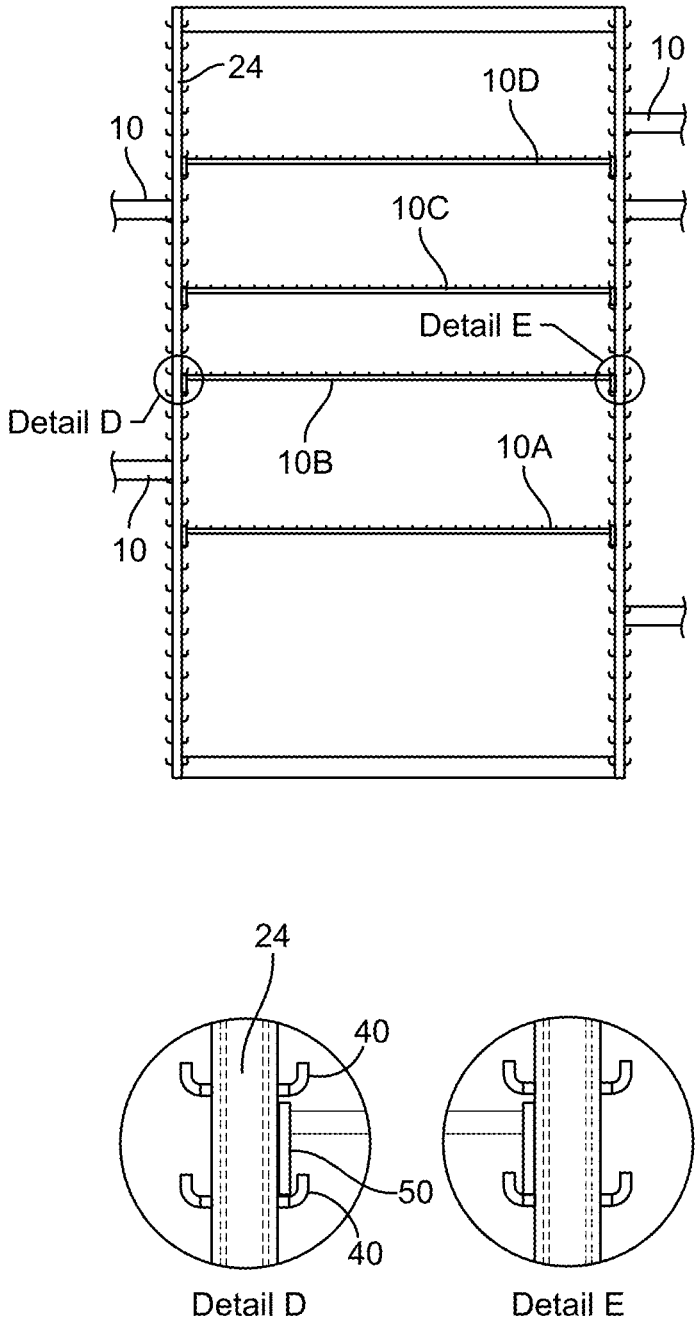
FIG. 6 is a rear elevation view of the present system, corresponding to FIG. 5, but with all the shelves returned to their horizontal position, illustrating how a vertical post may be used to support shelves on both its left and right sides. Detail views on each of the two rear supports are also illustrated.

The Detail views of FIG. 6 are a rear close-up perspective views centered on one of the rear vertical posts showing the position of the vertically spaced apart shelf supports on the sides of the rear vertical posts 24 with one of the side support rails 50 passing between a pair of the vertically spaced apart shelf supports 40. Different embodiments for shelf supports 40 are illustrated herein and it is to be understood that shelf supports 40 may be hooks, latches, connectors, hooks, latches, side protrusions or projections from the vertical posts, etc. The present invention is not limited to any one form or geometry for these shelf supports 40.

Figure 3B:
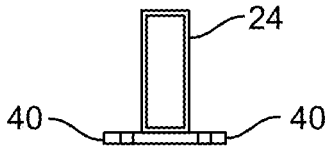
FIG. 3B is a top plan view corresponding to FIG. 3A.
Figure 3A:
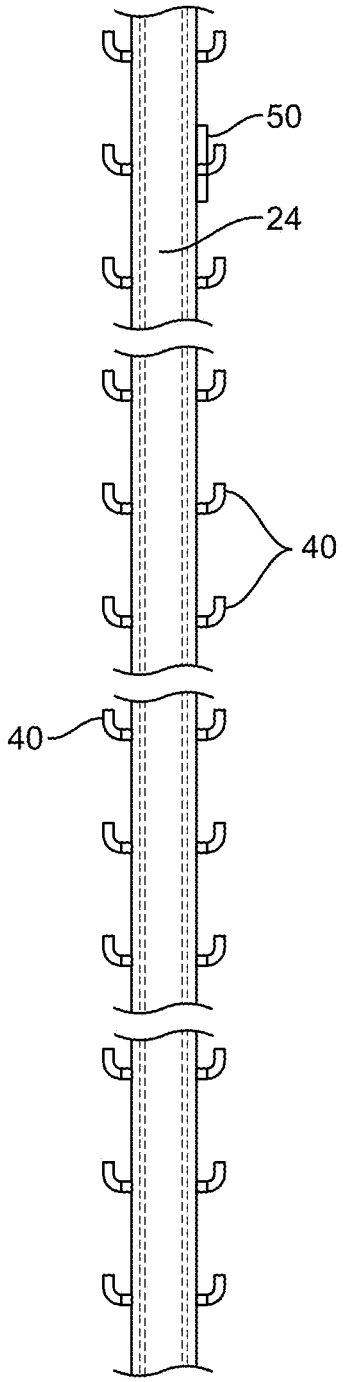
FIG. 3A is a rear side elevation view of one of the vertical posts.
Figure 3C:
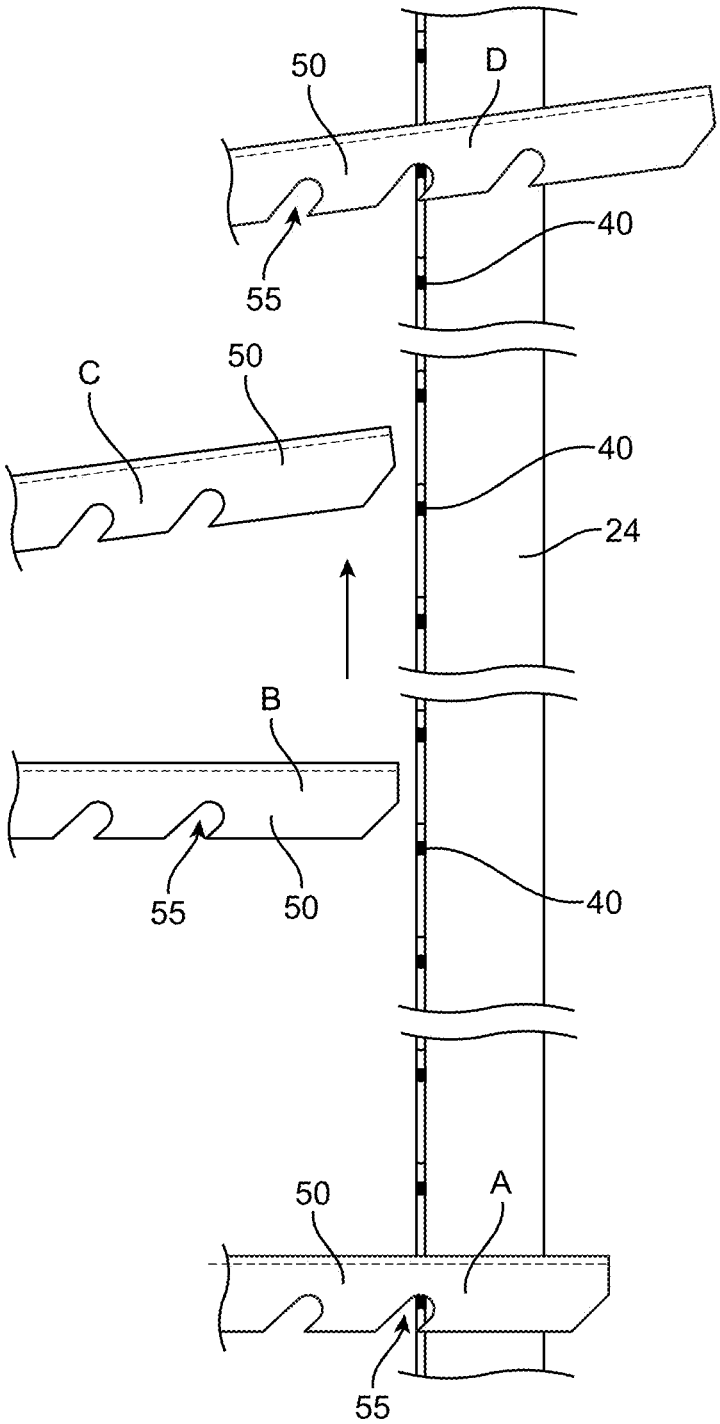
FIG. 3C is a side elevation view corresponding to FIG. 3A, showing the movement of the back end of the shelf from a horizontal position to an inclined position.

FIGS. 3A to 3C illustrate one preferred form of shelf supports 40 illustrating their interaction with side support rails 50. It is to be understood that in accordance with the present system, side support rails 50 may be part of the sides of shelf 10 or they may be mounted onto the sides of shelf 10. Moreover, each side support rail 50 may also instead comprise a front side rail portion that interacts with front vertical post 22 and a rear side rail portion that interacts with rear vertical post 24. In other words, the side support rails need not extend the full distance along the sides of the shelf, but can instead be split into two portions, with one interacting with the front vertical post 22 and the other interacting with the rear vertical post 24.

As seen in FIGS. 3A and 3C, the side support rails 50 may have a series of bottom notches 55 thereon. In preferred embodiments, the notches 55 lock or hook onto the vertically spaced apart shelf supports 40 on the vertical rear posts 24. Shelf supports 40 are received into notches 55, thereby holding and locking side support rails 50 in position which in turn holds the shelf in position. These notches may be made in different shapes. For example, notches 55 may be cactus-shaped, saw-tooth shaped, hook-shaped, sinusoidal in shape, projections or extension coming from the bottom of side support rails 50, etc. As seen in FIG. 3C, the operator may desire to change the angle of the shelf. This is done by simply lifting the shelf (to disconnect shelf supports 40 from notches 55), pushing the shelf forwards and then pulling shelf 10 backwards such that the rear end of the shelf can be raised or lowered by connecting it onto a higher or lower shelf support 40 (thus tilting the shelf forwards or backwards, as desired). For example, the shelf can first be sitting horizontally at position "A". Next, the operator can lift the shelf such that shelf supports 40 are disconnected from notches 55. The operator can then push the shelf slightly forward lifting it to position "B". Next, the operator can further lift the shelf to adjust the shelf to a desired (tilted slightly forward) position "C". Finally, the operator pulls the shelf backwards and hooks one of the notches 55 onto a higher shelf support 40, as shown in position "D". If desired, the operator could reverse these steps to lower the back end of the shelf to a lower position, for example to make the shelf horizontal again, or even to lower it farther such that it is instead tilted backwards.

While the rear of the shelf is being lifted or lowered to tilt the shelf forwardly or backwardly, the side support rails 50 will remain positioned between two of the vertically spaced apart shelf supports 40 on the front vertical posts 22. This provides a safety feature in the present invention that prevents the entire shelf from falling if the rear end is accidently dropped when its position is being adjusted, as will be explained further below.

Figure 4:
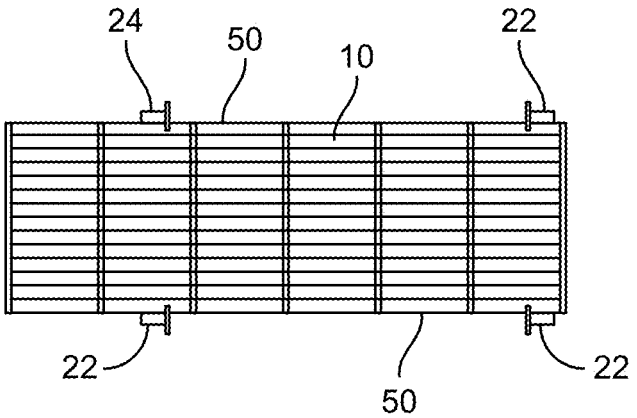
FIG. 4 is a top plan view of a shelf with side support rails, showing the position of the front and rear vertical posts holding the shelf.

FIG. 4 is a top plan view of shelf 10 showing the positions of side support rails 50 and front and rear vertical posts 22 and 24 holding the shelf.

Figure 5:
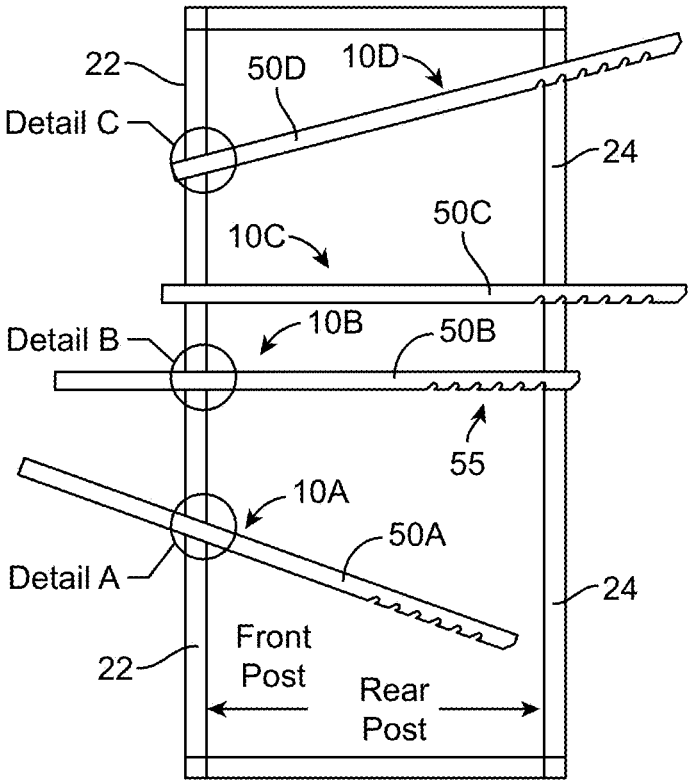
FIG. 5 is an interior side elevation view showing various positions of different shelves. Detail views of each of these positions are also illustrated.
Figure 5:
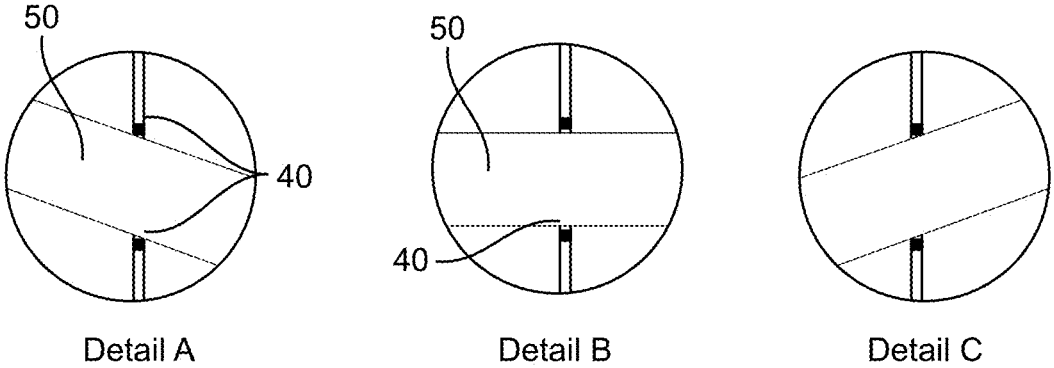

FIG. 5 is a side elevation view showing various positions of different shelves 10A, 10B, 10C and 10D. Detail views of each of these positions are also illustrated. In this illustration, side support rails 50A to 50D support shelves 10A to 10D which are hidden from view but are attached thereto. A first shelf 10A has had its side support rail 50 disconnected from rear vertical post 24 to adjust the angle of the shelf. Unfortunately, while doing this, the operator accidentally dropped the rear end of the shelf. As such, the rear end of side support rail 50 falls a short distance. However, as seen in Detail A, the top of side support 50 will rotate and bind against the upper shelf support 40 while the bottom of side support 50 will rotate and bind against the lower shelf support 40. As such, side support 50 will be locked into position and the shelf will not fall. A second shelf 50B is sitting horizontally, with the notches 55 in its side support rail 50 hooked or latched onto one of the shelf supports 40. Detail B illustrates the front of side support 50 sitting on top of one of the shelf supports 40. As can be seen, there are no notches 55 required at the front end of side support rail 50. As such, the side support rail is free to slide back and forth over the shelf supports 40 on front vertical post 22. Shelf 10C illustrates this further with the shelf being slid horizontally backwards from the position of shelf 10B. Finally, shelf 10D shows the back of the shelf being raised to tilt the shelf forwardly. When the shelf is in this position, the notches 55 in its side rails 50 will be locked onto one of the (higher) shelf supports 40 on rear vertical post 24. It is to be understood that the maximum tilt angles will be a function of the vertical height of the side rails 50 and the vertical separation distance between shelf supports 40.

FIG. 6 is a rear elevation view of the present system, corresponding to FIG. 5, but with shelves 10A, 10B, 10C and 10D being returned to their horizontal positions, illustrating how a vertical post 22 or 24 may be used to support additional shelves 10 on both its left and right sides. As such, the present system can be used in large display cabinets with multiple shelves 10 extending to the left and right while these shelves are supported by shared front and back vertical posts.

Figure 7:
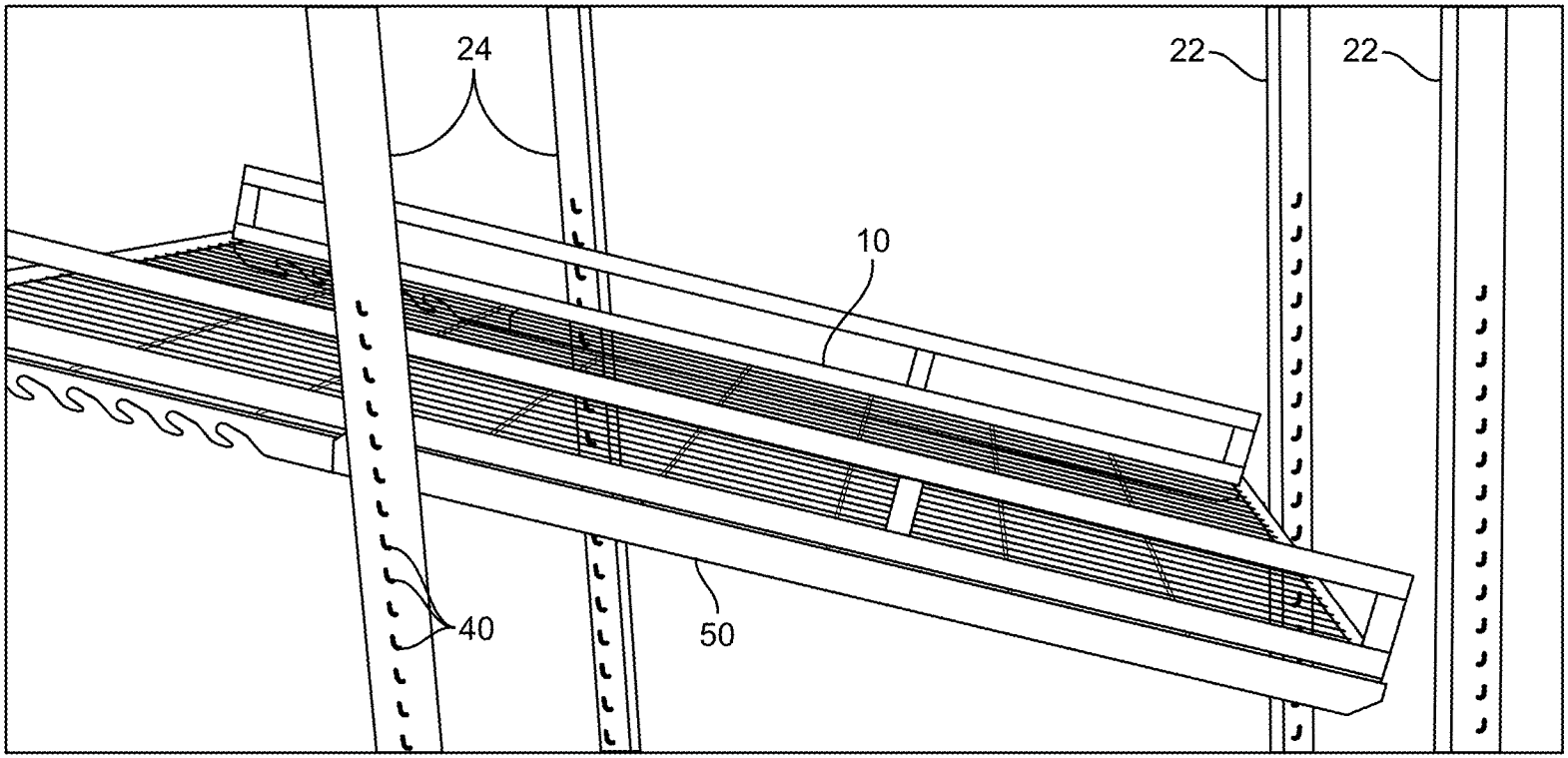
FIG. 7 is a perspective view similar to FIG. 5, but instead illustrating how the shelf will not fall if its front end is instead disconnected from the front vertical post and accidently dropped.

FIG. 7 is a perspective view similar to FIG. 5, but instead illustrates how the shelf will not fall if its front end is instead disconnected from the front vertical post 22 and accidently dropped. Specifically, if the shelf is pulled too far backwards during adjustment such that the front ends of side support rails 50 slid out from between the shelf supports 40 in front vertical posts 22, then the front end of the shelf may drop somewhat. However, the back ends of side support rails will simply rotate to lock between a pair of shelf supports 40 in rear vertical posts 24 instead.

Figure 9B:
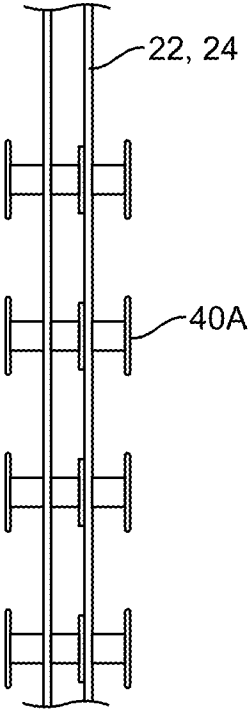
FIG. 9B is a front elevation view corresponding to FIG. 9A.
Figure 9A:
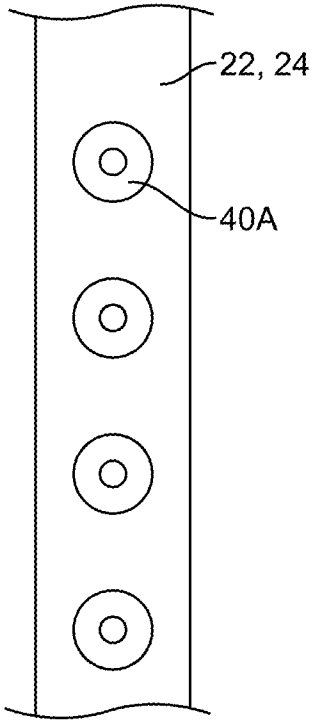
FIG. 9A is a side elevation view of one of the vertical posts having alternate shelf supports that are punched and formed from flat material that also provide enhanced finger protection.
Figure 8B:
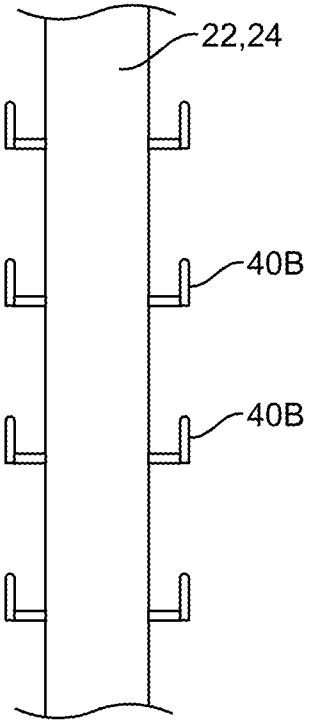
FIG. 8B is a front elevation view corresponding to FIG. 8A.
Figure 8A:
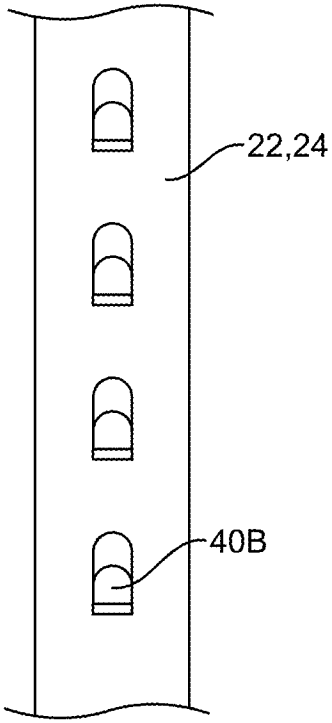
FIG. 8A is a side elevation view of one of the vertical posts having shelf supports without sharp edges mounted thereon, thereby providing finger protection. These shelf supports may be formed by a threaded rod passing through punched holes in the material, with weld nuts attached to the threaded rods.

FIGS. 8A and 8B are views of one of the vertical posts having shelf supports 40A that do not have sharp edges, thereby providing finger protection for the operator. These shelf supports may be formed by threaded rods passing between punched holes in the opposite sides of the post, with well nuts attached onto the threaded rods. Similarly, FIGS. 9A and 9B show alternate shelf supports 40B also having no sharp edges, again providing finger protection for the operator. These shelf supports may be formed by punching out sections of a flat metal member, bending the punch out into arms (as shown), and then folding the flat member into a rectangular (or other tubular) shape and welding it onto itself.

As seen in the various embodiments described herein, the front and rear vertical posts 22 and 24 may be rectangular in cross section. It is to be understood however that these posts may also be made in a variety of different constructions, including but not limited to being T-shaped, U-shaped, I-shaped or C-shaped in cross section.

In the illustrated embodiments, vertical posts 22 and 24 can together form a frame around the shelf. These bars may optionally be connected together by additional top, bottom or side members to form a frame or a box-like enclosure. It is to be understood that many different geometries are possible, and that vertical posts 22 and 24 may be attached together in different ways using different geometries, all keeping within the scope of the present system. For example, vertical posts 22 and 24 can be connected to systems that use or include refrigerator doors. The present system can optionally be constructed by attaching the front posts 22 to the doorframe and the rear posts 24 can be freestanding and held in place by the shelves. Other alternatives and designs are also contemplated, all keeping within the scope of the present invention.

In all of its various embodiments, the present system provides an elegant and non-obvious mechanism for positioning shelf 10 with respect to the vertical posts 22 and 24 (or frame encompassing these vertical posts) such that both the angle and horizontal position of shelf 10 can be adjusted by moving the shelf quickly, easily and safely without the need for moveable inserts, brackets, S-hooks etc.

What is claimed is:

1. A shelving system, comprising: (a) an assembly comprising:

two front vertical posts having a plurality of vertically spaced apart shelf supports simultaneously extending outwardly therefrom, wherein each shelf support is equally spaced apart from a corresponding adjacent shelf support from the plurality of shelf supports; and two rear vertical posts having a plurality of vertically spaced apart shelf supports simultaneously extending outwardly therefrom, wherein each shelf support of each rear vertical post are equally spaced apart from a corresponding adjacent shelf support from the plurality of shelf supports of each rear vertical post; and (b) a shelf comprising:

a main body, and a pair of side support rails on the main body;

wherein each of the side support rails are dimensioned to be received between a corresponding upper shelf support from the plurality of shelf supports of the front vertical posts and a corresponding lower shelf support from the plurality of shelf supports of the front vertical posts positioned immediately adjacent to a top and a bottom of one of the side support rails respectively on the front vertical posts and a corresponding upper shelf support from the plurality of shelf supports of the rear vertical posts and a corresponding lower shelf support from the plurality of shelf supports of the rear vertical posts positioned immediately adjacent to the top and the bottom of the one of the side support rails respectively on the rear vertical posts; and wherein the corresponding upper shelf supports and the corresponding lower shelf supports of each front vertical post and each rear vertical post are positioned a distance apart such that the side support rails are configured to rotate to lock against the corresponding upper shelf supports and corresponding lower shelf supports of the front vertical posts and the rear vertical posts respectively to secure a position of the shelf on the front and rear vertical posts.

2. The shelving system of claim 1, wherein the side support rails have a series of bottom notches or protrusions thereon.

3. The shelving system of claim 2, wherein the bottom notches or protrusions lock onto the vertically spaced apart shelf supports on the rear vertical posts.

4. The shelving system of claim 2, wherein the bottom notches or protrusions lock onto the vertically spaced apart shelf supports on the front vertical posts.

5. The shelving system of claim 2, wherein the notches are cactus-shaped or saw-tooth shaped.

6. The shelving system of claim 1, wherein a rear of the shelf can be lifted to tilt the shelf forwardly while the side support rails remain positioned between two of the vertically spaced apart shelf supports on the front vertical posts.

7. The shelving system of claim 1, wherein a rear of the shelf can be released and dropped to tilt the shelf backwardly while the side support rails remain positioned between two of the vertically spaced apart shelf supports on the front vertical posts.

8. The shelving system of claim 1, wherein a front of the shelf can be released and dropped to tilt the shelf forwardly while the side support rails remain positioned between two of the vertically spaced apart shelf supports on the rear vertical posts.

9. The shelving system of claim 1, wherein the side support rails can rotate to lock against the vertically spaced apart shelf supports above and below the side support rails if a rear or a front portion of the shelf is released and dropped.

10. The shelving system of claim 1, wherein the front and rear vertical posts are rectangular in cross section.

11. The shelving system of claim 1, wherein the front and rear vertical posts are T-shaped, I-shaped, U-shaped or C-shaped in cross section.

12. The shelving system of claim 1, wherein the series of vertically spaced apart shelf supports on each of the front and rear vertical posts comprise pairs of shelf supports for supporting shelves on each of the left and right sides of the vertical posts.

13. The shelving system of claim 1, wherein the shelf is a wireframe shelf.

* * * * *